US007860683B2

(12) United States Patent
Kunze et al.

(10) Patent No.: US 7,860,683 B2
(45) Date of Patent: Dec. 28, 2010

(54) DEVICE AND METHOD FOR STATE MONITORING IN HYDROSTATIC DISPLACEMENT UNITS

(75) Inventors: Thomas Kunze, Neu-Ulm (DE); Wilfried Eichner, Neubulach (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 410 days.

(21) Appl. No.: 11/922,657

(22) PCT Filed: Dec. 12, 2006

(86) PCT No.: PCT/EP2006/011952

§ 371 (c)(1),
(2), (4) Date: Dec. 20, 2007

(87) PCT Pub. No.: WO2007/068448

PCT Pub. Date: Jun. 21, 2007

(65) Prior Publication Data

US 2009/0229456 A1 Sep. 17, 2009

(30) Foreign Application Priority Data

Dec. 13, 2005 (DE) ..... 10 2005 059 564

(51) Int. Cl.
*G06F 11/30* (2006.01)

(52) U.S. Cl. ..... 702/184

(58) Field of Classification Search ..... 702/184
See application file for complete search history.

(56) References Cited

U.S. PATENT DOCUMENTS

| | | | | |
|---|---|---|---|---|
| 5,213,477 | A | 5/1993 | Watanabe et al. | |
| 5,251,151 | A * | 10/1993 | Demjanenko et al. | 702/56 |
| 5,737,994 | A | 4/1998 | Escobosa | |
| 2004/0079158 | A1 | 4/2004 | Mercer | |
| 2004/0167738 | A1 * | 8/2004 | Miller | 702/114 |

FOREIGN PATENT DOCUMENTS

| | | |
|---|---|---|
| DE | 41 33 269 | 4/1993 |
| DE | 195 46 299 | 7/1996 |
| DE | 199 51 961 | 5/2001 |
| DE | 101 43 206 | 7/2002 |
| DE | 102 44 203 | 4/2004 |
| DE | 103 34 817 | 3/2005 |
| DE | 199 27 961 | 9/2005 |
| DE | 102004028643 | 9/2005 |
| WO | WO 02/33260 | 4/2002 |

* cited by examiner

*Primary Examiner*—Aditya Bhat
(74) *Attorney, Agent, or Firm*—Scully, Scott, Murphy & Presser, P.C.

(57) ABSTRACT

The invention relates to a device (1) for state monitoring in hydrostatic displacement units (2), in particular in axial piston machines (3) operated as a pump or as a motor. The device (1) comprises an acquisition unit (4) with a multiplicity of sensors (5) which are attached to the hydrostatic displacement unit (2) and serve to acquire monitoring data (6) and operating data (7), and an evaluating unit (8) which has a device (9) for analysing the monitoring data in the frequency range and a device (10) for analysing the monitoring data in the time range. A diagnostic unit (11) with an output unit (13) is connected to the evaluating unit (8).

20 Claims, 3 Drawing Sheets

DEVICE AND METHOD FOR STATE MONITORING IN HYDROSTATIC DISPLACEMENT UNITS

The invention relates to a device and a method for state monitoring in hydrostatic displacement units.

If hydraulic installations are out of operation on account of maintenance work or a malfunction, costly downtimes result, during which replacement parts must be replaced. In addition, contamination of the entire hydraulic circuit may also result in a downtime, so that the entire installation must be cleaned and the hydraulic oil as well as system components, such as, for example, filter elements, must be replaced before the installation is put into operation again. If hydraulic installations are not in operation, for example in a production line, the result is not only a reduced production output but also very high costs for shutting down and restarting the hydraulic installation.

In order to reduce stoppages, a device and a method for fault diagnosis are to be found in the prior art.

For example, a device and a method for fault detection on pumps are known from DE 103 34 817 A1, in which, after acquisition of a pressure of the pump, a frequency analysis, preferably a discrete Fourier transformation, of the acquired data signal is carried out and following that the amplitude of a characteristic frequency of the pump, which was obtained by the frequency analysis, is compared with a reference amplitude and a pump fault is ascertained from this comparison. In this case, the characteristic frequency of the pump is preferably the natural frequency of the pump drive.

A disadvantage of the prior art disclosed in DE 103 34 817 A1 is that only the pressure of a pump is analysed, solely in the frequency range. If the pump is in danger of breaking down due to increased contamination of the hydraulic fluid, this cannot be directly diagnosed by the device described in DE 103 34 817 A1, but rather only conclusions can be drawn from a pressure increase in the hydraulic circuit, since the device has no sensor which determines, for example, the concentration of dirt particles in the hydraulic fluid. Another disadvantage is that possible mechanical instabilities which are caused by a high rotational speed of the pump and are transmitted to the pump housing cannot be directly acquired, since no corresponding sensors are attached to the pump housing.

In addition, event-oriented maintenance of such installations, i.e. a repair caused by a case of damage, and cycle-oriented maintenance which relates to maintenance at fixedly predetermined time intervals are disadvantageous, since they entail a prolonged downtime and thus higher process costs.

The present invention has the object of eliminating the disadvantages in the prior art and providing a device and a method for fault detection with extended functional scope for state-oriented maintenance in hydrodynamically operated machines.

The object is achieved according to the invention, with regard to the device, by the features of claim 1 and, with regard to the method, by the features of claim 18.

Claim 1 relates to a device for state monitoring in hydrostatic displacement units, in particular in axial piston machines operated as a pump or as a motor. The device according to the invention has an acquisition unit with a multiplicity of sensors which are attached to the hydrostatic displacement unit and serve to acquire monitoring data and operating data, the acquisition unit being connected to an evaluating unit which comprises both a device for analysing the monitoring data in the frequency range and a device for analysing the monitoring data in the time range. A diagnostic unit with an output unit is connected to the evaluating unit.

Claim 18 relates to a method for state monitoring by means of the device according to the invention in hydrostatic displacement units, in particular in axial piston machines operated as a pump or as a motor, a multiplicity of sensors which acquire monitoring data and operating data in an acquisition unit being attached to the hydrostatic displacement unit. Subsequently, the monitoring data are analysed both in the frequency range and in the time range in the evaluating unit, so that a signal can then be output by the output unit connected to the diagnostic unit in dependence on the result of the preceding analysis.

The measures stated in the subclaims relate to advantageous developments of the invention.

In particular, it is advantageous that the evaluating unit of the device according to the invention for state monitoring comprises both a device for analysing the monitoring data in the frequency range and a device for analysing the monitoring data in the time range. It is thus possible for the natural frequencies of the entire system to be ascertained and stored by simple means.

Furthermore, it is advantageous that a multiplicity of sensors are attached to the hydrostatic unit, with which sensors both monitoring data and operating data, such as pressure in a high-pressure line and/or pressure in a low-pressure line and/or a pivot angle of a swash plate and/or a rotational speed of a cylinder drum, are acquired metrologically, in order subsequently to be analysed in the evaluating unit with regard to their relationship.

In this regard, it is advantageous that the monitoring data, such as surface vibrations and/or leak-oil and hydraulic-fluid temperature and/or hydraulic-fluid state, in conjunction with the operating data ascertained, characterise the overall state of the machine to be monitored, and thus necessary maintenance is indicated even before it is due, so that any downtime necessary can be well coordinated with the production process.

Moreover, it is advantageous that the monitoring data are analysed in the evaluating unit also in the time range, so that a trend behaviour of the machine state can be determined by obtaining a quotient of a measured actual value to a defined threshold value or of a change of the actual value to a defined threshold value.

In addition, it is advantageous that at least three acceleration sensors are attached to the housing of the hydrostatic displacement unit, so that surface vibrations of the housing can be acquired in three directions which are perpendicular to one another in pairs.

Furthermore, it is advantageous that an output unit is connected to the diagnostic unit defining the machine state, in which output unit a pre-alarm or a main alarm is output in relation to the diagnosed machine state.

A preferred embodiment of the device according to the invention for state monitoring in hydrostatic displacement units is illustrated in the drawing and explained in more detail in the following description. In the drawing.

Figure 1:
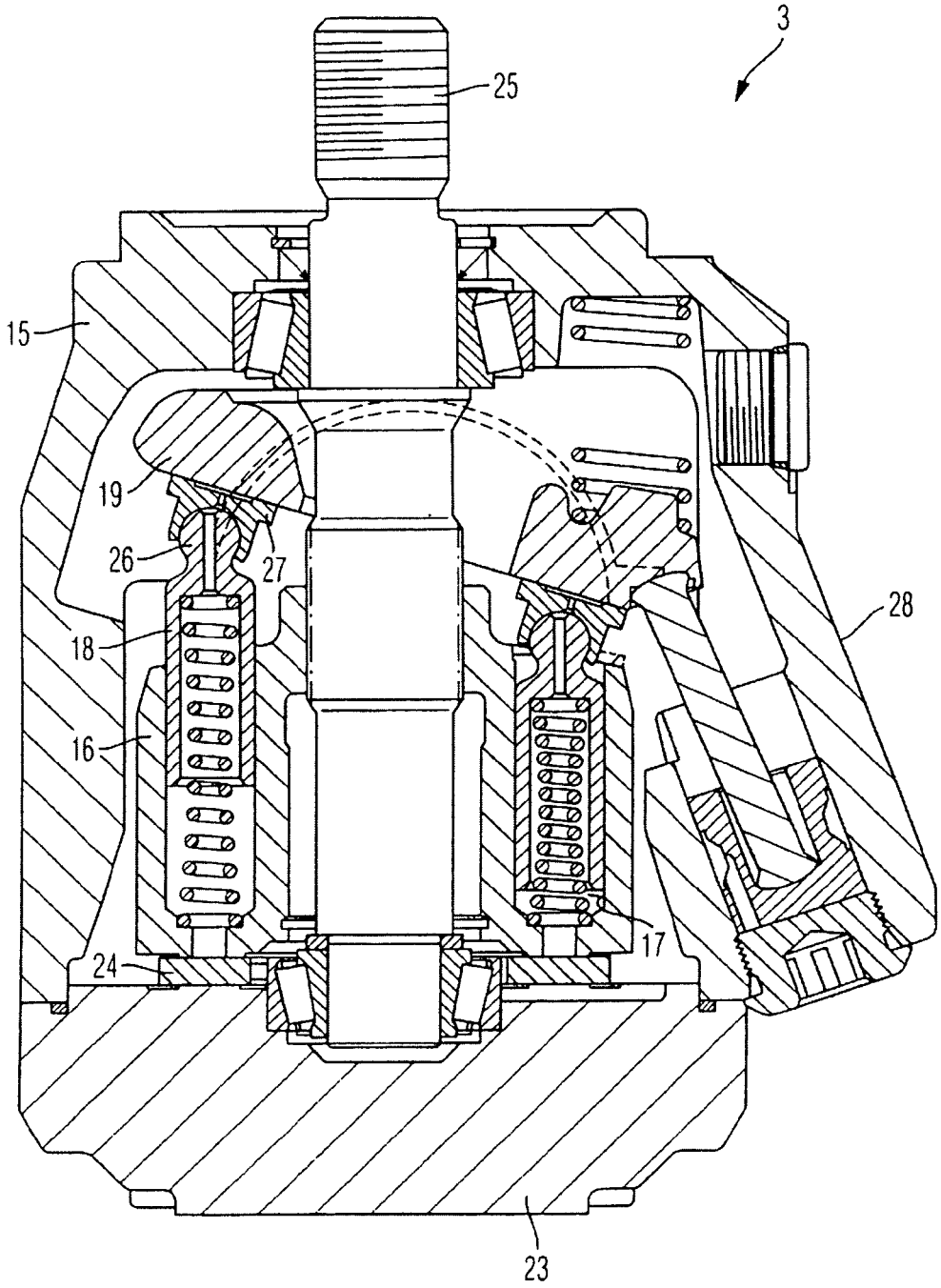
FIG. 1 shows a schematic illustration of an axial piston machine for explaining the acquired monitoring data and operating data.

The axial piston machine 3 illustrated in FIG. 1 is constructed in a swash-plate design with adjustable displacement volume and one flow direction, and comprises in a known manner, as essential components, a substantially hollow-cylindrical housing 15 with a frontally open end (lower end in FIG. 1), a housing cover 23 fastened to the housing 15 and closing its open end, a swash plate 19, also called a cam plate, a control plate 24, a shaft 25 and a cylinder drum 16. By means of a suitable sensor, not shown in this illustration, a pivot angle of the swash plate 19 is ascertained and transmitted to an acquisition unit 4 of the device 1 according to the invention for state monitoring in hydrostatic displacement units 2.

The shaft 25 is rotatably mounted in the housing 15 and passes in a centred manner through the cylinder drum 16. The cylinder drum 16 is connected in a rotationally fixed manner to the shaft 25 but such that it can move axially and thereby be withdrawn from the shaft. The shaft is mounted, on both sides of the cylinder drum 16, in a respective rolling bearing. Attached to the shaft 25 is a rotational-speed sensor, not visible in this illustration, which determines the instantaneous rotational speed of the shaft 25 and passes it on to the acquisition unit 4.

A plurality of cylinder bores 17 are formed in the cylinder drum 16 in a manner distributed over the circumference. In each cylinder bore 17, a respective piston 18 is axially movably inserted. The pistons 18 each have, on the side facing away from the housing cover 23, a spherical head 26 which cooperates with a corresponding recess of a slide shoe 27 to form a knuckle joint. By means of the slide shoe 27, the piston 18 is supported on the swash plate 19. Upon rotation of the cylinder drum 16, the pistons 18 therefore perform a reciprocating movement in the cylinder bores 17. The length of stroke is predetermined by the position of the swash plate 19, the position of the swash plate 19 being adjustable by an adjusting device 28.

The control openings, not visible in the illustrated section of FIG. 1 of the axial piston machine 3, of the control plate 24 are in permanent contact, on their side facing away from the cylinder drum 16, with at least one high-pressure or low-pressure connection, not illustrated in this figure.

The cylinder bores 17 are open, via openings, towards the front face of the cylinder drum 16. Upon rotation of the cylinder drum 4, the openings sweep over sealing surroundings of the control plate 24 and, during one revolution, are alternately connected to the control openings, not visible.

The functioning of the above-described axial piston machine 3 is generally known and is restricted to the essential aspects in the description below where the machine is used as a pump.

The axial piston machine 3 is provided, for example, for operation with oil as the hydraulic fluid. The cylinder drum 16 together with the pistons 18 is set in rotation via the shaft 25. If the swash plate 19 is pivoted into an oblique position with respect to the cylinder drum 16 by actuation of the adjusting device 28, all the pistons 18 perform reciprocating movements. Upon rotation of the cylinder drum 16 through 360°, each piston 18 passes through a suction stroke and a compression stroke, producing corresponding oil flows which are supplied and discharged via the openings, the control openings, not visible, of the control plate 24 and the high-pressure or low-pressure connection, not illustrated.

Figure 2:
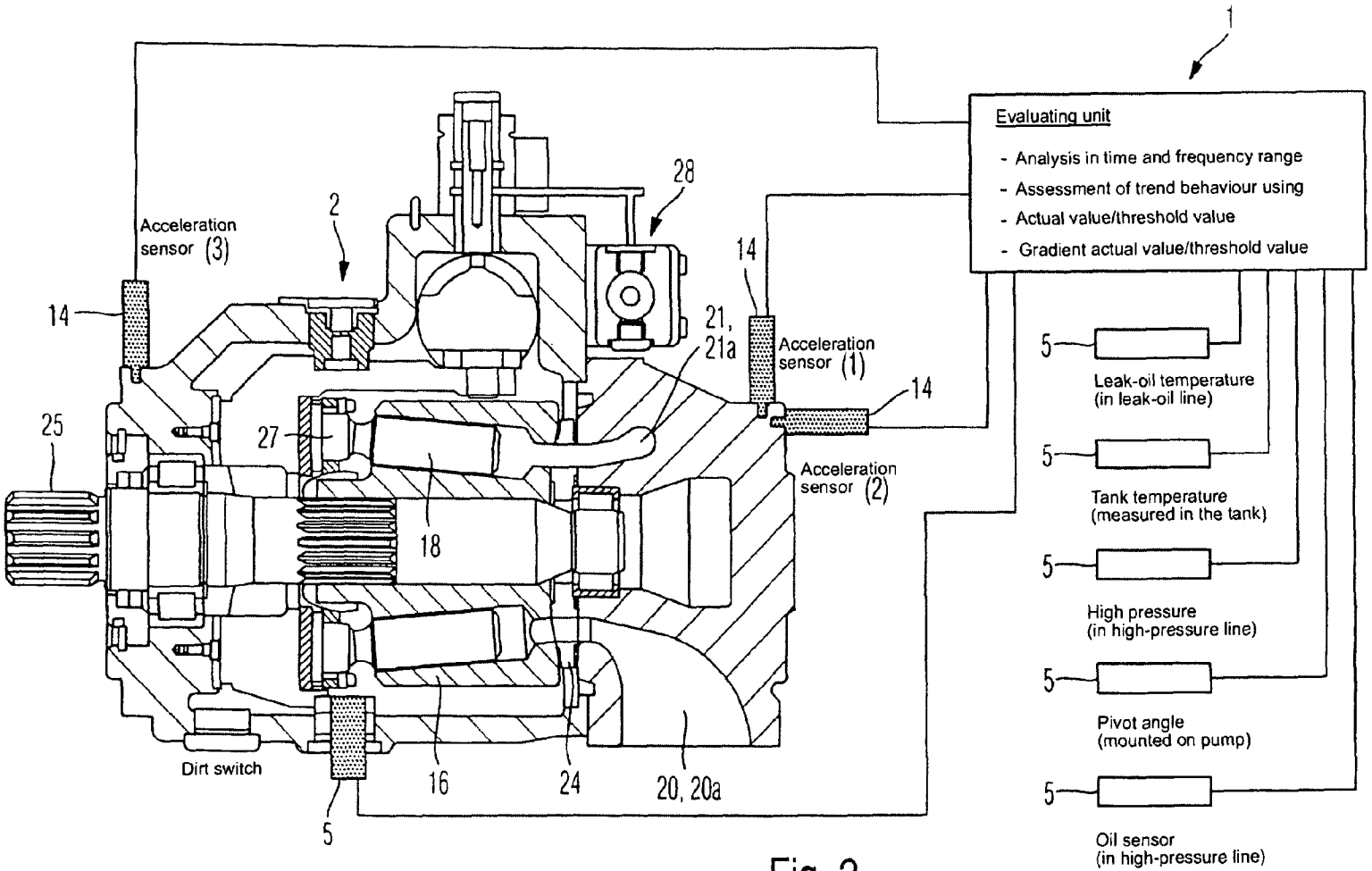
FIG. 2 shows a schematic illustration of a device according to the invention for state monitoring.
Figure 3:
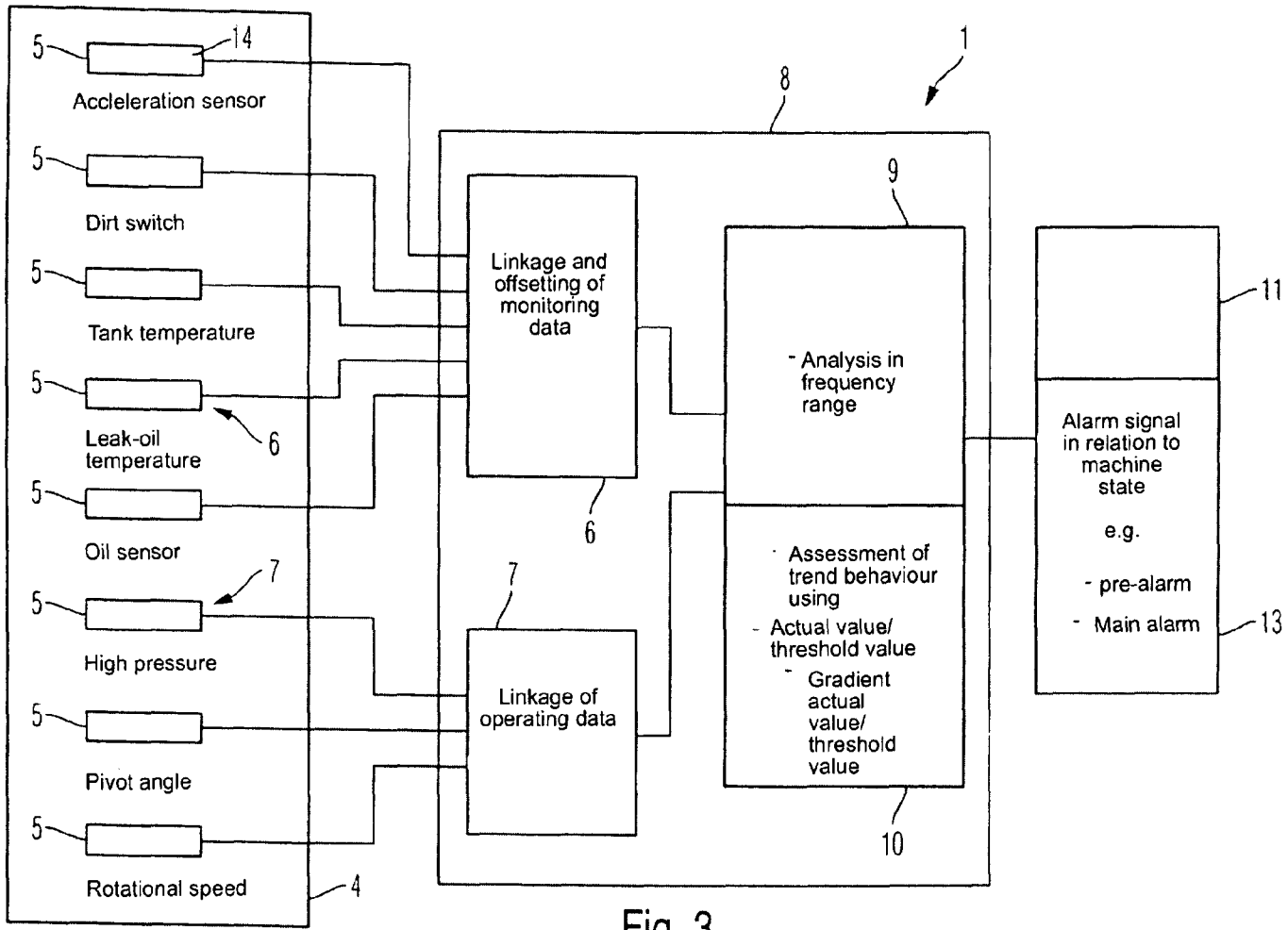
FIG. 3 shows a block diagram for explaining the method according to the invention for state monitoring.

FIG. 2 shows a schematic illustration of a device 1 according to the invention for state monitoring of a hydrostatic displacement unit 2, the design of which corresponds essentially to the axial piston machine 3 illustrated in FIG. 1. The device 1 for state monitoring in hydrostatic displacement units 2, in particular in axial piston machines 3 operated as a pump or as a motor, comprises an acquisition unit 4 with a multiplicity of sensors 5 attached to the hydrostatic displacement unit 2. These sensors 5 acquire both monitoring data 6 and operating data 7. Furthermore, the device 1 according to the invention has an evaluating unit 8 with a device 9 for analysing the monitoring data 6 in the frequency range and a device 10 for analysing the monitoring data 6 in the time range. Connected to the evaluating unit 8 is a diagnostic unit 11 with an output unit 13, it also being possible for the diagnostic unit 11 to be integrated in the evaluating unit 8, as shown in FIG. 3.

The monitoring data 6 comprise surface vibrations and/or leak-oil and hydraulic-fluid temperature and/or hydraulic-fluid state, in particular contamination level, at least three acceleration sensors 14 connected to the acquisition unit 4 being attached to at least three different places on the housing 15 of the hydrostatic displacement unit 2 for the purpose of acquiring the surface vibrations. The directions of the accelerations or vibrations to be measured by the three acceleration sensors 14 are in each case perpendicular to one another in pairs.

The device 9 for analysing the monitoring data 6 in the frequency range comprises a module which forms the Fourier transform of the acquired monitoring data 6, in particular of the surface vibrations.

The leak-oil temperature of the hydraulic fluid is acquired by a sensor 5 arranged, for example, in the pump housing 15 or in a leak-oil line connected to the pump housing 15 and is transmitted via the acquisition unit 4 to the evaluating unit 8 of the device 1 according to the invention, where this value is stored with other monitoring data 6.

The device 10 for analysing the monitoring data 6 in the time range has a module for assessing a trend behaviour using a quotient of actual value/threshold value and a quotient of change of the actual value to a threshold value, the actual value relating both to monitoring data 6 and to operating data 7.

A linkage of monitoring data 6 to operating data 7 is provided in the diagnostic unit 11 of the device 1 according to the invention for state monitoring, the threshold values being definable for the monitoring data 6 dependent on the operating data 7. A pre-alarm and a main alarm are provided in the output unit 13 connected to the diagnostic unit 11 as alarm signals in relation to a machine state, a pre-alarm indicating the next maintenance which is due and a main alarm indicating a machine state critical to further operation and additionally also being able to actuate the emergency switch.

FIG. 3 shows a block diagram for explaining the method according to the invention for state monitoring. The method for state monitoring starts from the point where a multiplicity of sensors 5 are attached to the hydrostatic displacement unit 2. In the exemplary embodiment, the attached sensors 5 comprise acceleration sensors 14, dirt switches, temperature sensors in the tank, and in the leak-oil duct, oil sensors, pressure sensors in the high-pressure line 21 and in the low-pressure line 20, a rotational-speed sensor attached to the shaft 25 and a sensor 5 for determining the pivot angle. These sensors 5 acquire the relevant data and transmit them as monitoring data 6 and operating data 7 to an acquisition unit 4.

The monitoring data 6 relate to surface vibrations, to a particle concentration in the hydraulic fluid, to the temperatures in the tank and in the leak-oil line and to viscosity values, water content, dielectricity values and pressure values of the hydraulic fluid used in the hydraulic circuit.

The operating data 7 relate to the pressure in a high-pressure line 21 and/or the pressure in a low-pressure line 20 and/or the pivot angle of a swash plate 19 and/or the rotational speed of a cylinder drum 16.

In the evaluating unit 8 which is connected to the acquisition unit 4, the monitoring data 6 are analysed both in the frequency range and in the time range. After the data analysis, a signal is output by the output unit 13 connected to the diagnostic unit 11 in dependence on the result of the preceding data analysis.

The monitoring data 6, in particular the surface vibrations measured by means of at least three acceleration sensors 14 attached to the housing of the hydrostatic displacement unit 2, undergo a Fourrier transformation. By this means, the natural frequencies and/or fault frequencies of the entire system are ascertained. On the basis of these natural frequencies and/or fault sequences, a critical operating state of the displacement unit 2 can be ascertained and indicated via a suitable visual or acoustic alarm signal.

In the device 10 for analysing the monitoring data 6 in the time range, the quotient of an actual value and a threshold value is obtained. For example, the concentration of dirt particles in the hydraulic circuit is determined at regular time intervals and set in relation to a predefined limit concentration stored in the evaluating unit 8. The result of this quotient is continuously monitored in the diagnostic unit 11, so that a suitable alarm is output when the value one is approached.

Furthermore, in the device 10 for analysing the monitoring data 6 in the time range, a quotient of the change of the actual value and a predefined threshold value is obtained. For example, at regular time intervals, a change of the temperature in the tank is acquired and set in relation to a predefined temperature. A sudden increase of this quotient is then an indication of a changed trend behaviour of the monitored measurement parameter, so that thereupon an alarm is output after a trend behaviour of the monitoring data has been assessed in the time range in the diagnostic unit 11 using the quotients obtained in the evaluating unit.

The invention is not restricted to axial piston machines 3 of swash-plate design and is, for example, also usable for axial piston machines 3 of oblique-axis design or further hydrostatic displacement units 2 with a closed or open hydraulic circuit.

The invention claimed is:

1. A device for state monitoring in hydrostatic displacement units, comprising:

an acquisition unit with a multiplicity of sensors which are attached to the hydrostatic displacement unit and serve to acquire monitoring data and operating data, an evaluating unit which comprises a first device for analysing the monitoring data in the frequency range and a second device for analysing the monitoring data in the time range, and a diagnostic unit, to which an output unit is connected, wherein the second device comprises a module for assessing a trend behavior by at least one of a quotient of actual value to a threshold value and a quotient of change of the actual value to a threshold value, and wherein a linkage of monitoring data to operating data is provided in the diagnostic unit, and definable threshold values for the monitoring data are provided dependent on the operating data.

2. The device for state monitoring according to claim 1, wherein the first device for analysing the monitoring data in the frequency range comprises a module for Fourrier transformation of the acquired monitoring data.

3. The device for state monitoring according to claim 1, wherein at least three acceleration sensors connected to the acquisition unit are attached to a housing of the hydrostatic displacement unit.

4. The device for state monitoring according to claim 3, wherein the acceleration sensors are attached to three different places on a housing of the hydrostatic displacement unit.

5. The device for state monitoring according to claim 3, wherein the directions of the accelerations or vibrations to be measured by the three acceleration sensors are in each case perpendicular to one another in pairs.

6. The device for state monitoring according to claim 1, wherein the hydrostatic displacement unit has cylinder bores which are arranged in a cylinder drum and have pistons axially movable in the cylinder bores, each piston being supported on an adjustable swash plate, and wherein the operating data relate to at least one of a pressure in a high-pressure line, a pressure in a low-pressure line of the hydrostatic displacement unit, a pivot angle of the swash plate and a rotational speed of the cylinder drum.

7. The device for state monitoring according to claim 1, wherein the monitoring data are obtained by the sensors provided at the corresponding places and are transmitted to the acquisition unit of the device for state monitoring.

8. The device for state monitoring according to claim 7, wherein the monitoring data comprise vibrations measured by three acceleration sensors.

9. The device for state monitoring according to claim 7, wherein the monitoring data comprise temperatures determined by means of a sensor in a leak-oil line.

10. The device for state monitoring according to claim 7, wherein the monitoring data comprise temperature values, viscosity values and pressure values ascertained by means of a sensor mounted in a hydraulic fluid.

11. The device for state monitoring according to claim 7, wherein the monitoring data comprise temperature values ascertained by means of a temperature sensor mounted in a tank for the hydraulic fluid.

12. The device for state monitoring according to claim 7, wherein the monitoring data comprise contamination levels ascertained by means of at least one of a particle sensor mounted in the tank for the hydraulic fluid and a particle sensor mounted in the leak-oil line.

13. The device for state monitoring according to claim 1, wherein a pre-alarm and a main alarm are provided in the output unit connected to the diagnostic unit, as alarm signals in relation to a machine state.

14. The device for state monitoring according to claim 13, wherein the alarm signals in the output unit comprise acoustic signals.

15. The device for state monitoring according to claim 13, wherein the alarm signals in the output unit comprise visual signals.

16. A method for state monitoring by means of a device in hydrostatic displacement units, the device comprising an acquisition unit with a multiplicity of sensors which are attached to the hydrostatic displacement unit and serve to acquire monitoring data and operating data, an evaluating unit which comprises a first device for analysing the monitoring data in the frequency range and a second device for analysing the monitoring data in the time range, and a diagnostic unit to which an output unit is connected, the method comprising:

sensing with a multiplicity of sensors, acquiring monitoring data and operating data in the acquisition unit being attached to the hydrostatic displacement unit, analyzing the monitoring data both in the frequency range and in the time range in the evaluating unit, obtaining a quotient of an actual value and a defined threshold value in at least one of the first device for analysing the monitoring data in the frequency range and the second device for analysing the monitoring data in the time range, assessing a trend behavior of the monitoring data in at least one of the time range and frequency range in the diagnostic unit using the quotient obtained in the evaluating unit, and outputting a pre-alarm or main-alarm by the output unit connected to the diagnostic unit in dependence on the result of a preceding analysis.

17. The method for state monitoring according to claim 16, wherein the sensors acquire monitoring data, such as surface vibrations and/or leak-oil and hydraulic-fluid temperature and/or hydraulic-fluid state, in a particular contamination level.

18. The method for state monitoring according to claim 16, wherein the acquired monitoring data, in particular the surface vibrations measured by means of at least three acceleration sensors, are Fourrier-transformed in the evaluating unit.

19. The method for state monitoring according to claim 16, wherein the sensors acquire operating data, such as pressure in a high-pressure line and/or pressure in a low-pressure line and/or a pivot angle of a swash plate and/or a rotational speed of a cylinder drum.

20. The method for state monitoring according to claim 16, wherein the quotient of a change of the actual value and a defined threshold value is obtained in at least one of the first device for analysing the monitoring data in the frequency range and the second device for analysing the monitoring data in the time range monitoring data in the time range and/or frequency range.

* * * * *